US005934927A

United States Patent [19]

Nagai

[11] Patent Number: 5,934,927

[45] Date of Patent: Aug. 10, 1999

[54] TERMINAL RETAINING CONSTRUCTION OF PRESS-CONNECTING CONNECTOR

[75] Inventor: Kentarou Nagai, Shizuoka, Japan

[73] Assignee: Yazaki Corporation, Tokyo, Japan

[21] Appl. No.: 09/035,868

[22] Filed: Mar. 6, 1998

[30] Foreign Application Priority Data

Mar. 7, 1997 [JP] Japan ..... 9-053191

[51] Int. Cl.[6] ..... H01R 4/24; H01R 13/422

[52] U.S. Cl. ..... 439/397; 439/595

[58] Field of Search ..... 439/397–400, 439/406, 407, 595

[56] References Cited

U.S. PATENT DOCUMENTS

| | | | |
|---|---|---|---|
| 4,344,665 | 8/1982 | Racilla et al. | 439/407 |
| 5,380,220 | 1/1995 | Okabe | 439/595 |
| 5,769,654 | 6/1998 | Onoda | 439/399 |
| 5,879,183 | 3/1999 | Okabe | 439/397 |

*Primary Examiner*—Neil Abrams
*Attorney, Agent, or Firm*—Sughrue, Mion, Zinn, Macpeak & Seas, PLLC

[57] ABSTRACT

There is disclosed a terminal retaining construction of a press-connecting connector which can positively retain a press-connecting terminal on terminal retaining portions of a housing, without reducing the strength of that portion of the press-connecting terminal where press-connecting blades for press-connection to a wire are formed. Each of press-connecting terminals 13 can be retained by terminal retaining portions 15 in a corresponding terminal receiving chamber 12 in a housing 11, the terminal having press-connecting blades 16 to which a wire can be press-connected. The press-connecting blades 16 are formed by stamping on each of opposite side walls 13*b* of the press-connecting terminal 13 to thereby form a window 17 through the side wall 13*b*, and the window 17 can be retainingly engaged with the associated terminal retaining portion 15 of the housing 11. Each of the opposite side walls 13*b* of the press-connecting terminal 13 has an interconnecting portion 18 extending upwardly from the window 17 to an upper edge 13*d* of the side wall 13*b*. A retaining recess 19 is formed in that portion of a bottom plate portion 13*a* of the press-connecting terminal 13 opposed to each of the windows 17, and the retaining recess 19 can be retainingly engaged with the associated terminal retaining portion 15 of the housing 11.

7 Claims, 3 Drawing Sheets

TERMINAL RETAINING CONSTRUCTION OF PRESS-CONNECTING CONNECTOR

BACKGROUND OF THE INVENTION

This invention relates to a terminal retaining construction of a press-connecting connector, and more particularly to a terminal retaining construction of a press-connecting connector in which press-connecting blades are formed by stamping on side walls of a press-connecting terminal to thereby form windows respectively through these side walls, and these windows serve as retaining portions for retaining engagement with a housing.

There is known a press-connecting connector which is compact in size, and has an improved wire-holding ability, and enables the automatic mounting of terminals. Such a connector will be described with reference to FIGS. 1 and 2. The press-connecting connector 1 comprises a housing 2, press-connecting terminals 4 received respectively in terminal receiving chambers 3 in the housing 2, and a cover 5 for covering the housing 2. Projected terminal retaining portions 3*a* are formed respectively on opposite side walls of each terminal receiving chamber 3 in the housing 2, and slits 4*b* and 4*b*, formed respectively in opposite side edges of a bottom plate portion 4*a* of the press-connecting terminal 4, are retainingly engaged with the terminal retaining portions 3*a* and 3*a*, respectively. A pair of press-connecting blades 4*c* and 4*c*, formed by bending, are disposed adjacent to each of the slits 4*b* and 4*b* in the press-connecting terminal 4. As shown in FIG. 2, a sheathed wire 7 is pressed against the two pairs of press-connecting blades 4*c* by a press-connecting jig 6, and an insulating sheath 8 of the sheathed wire 7 is cut by the two pairs of press-connecting blades 4*c*, so that a conductor 9 of the sheathed wire 7 is press-connected to the two pairs of press-connecting blades 4*c*.

However, in the terminal retaining construction of the above conventional press-connecting connector 1, the pair of press-connecting blades 4*c* are formed near to each of slits 4*b* formed in the bottom plate portion 4*a* of the press-connecting terminal 4, and therefore a shearing area at this portion is small, and besides that portion of the press-connecting terminal 4, disposed between that portion where the press-connecting blades 4*c* are formed and a tubular contact portion 4*d* of a square cross-section for contact with a mating terminal, has a reduced strength, and therefore the press-connecting terminal 4 is liable to be deformed upon application of an external force.

SUMMARY OF THE INVENTION

The present invention has been made in order to overcome the above problems, and an object of the invention is to provide a terminal retaining construction of a press-connecting connector which can positively retain a press-connecting terminal on terminal retaining portions of a housing, without reducing the strength of that portion of the press-connecting terminal where press-connecting blades for press-connection to a wire are formed.

According to the first aspect of the present invention, there is provided a terminal retaining construction of a press-connecting connector wherein each of press-connecting terminals can be retained by terminal retaining portions provided in a corresponding terminal receiving chamber in a housing, the terminal having press-connecting blades to which a wire can be press-connected; and the press-connecting blades are formed by stamping on each of opposite side walls of the press-connecting terminal to thereby form a window through the side wall, and the window can be retainingly engaged with the associated terminal retaining portion of the housing.

In this terminal retaining construction of a press-connecting connector, the strength of the press-connecting blade-formed portion of the press-connecting terminal is prevented from being reduced, and the press-connecting terminal can be easily and positively retained on the terminal retaining portions of the housing.

In the above-mentioned terminal retaining construction, preferably, in which each of said press-connecting blades comprises a pair of press-connecting blade elements which are separated at a predetermined interval in a longitudinal direction of said terminal, said window being formed between the basal ends of said press-connecting blade elements.

In a terminal retaining construction of a press-connecting connector as defined in the first aspect of the present invention, each of the opposite side walls of the press-connecting terminal has an interconnecting portion extending upwardly from the window to an upper edge of the side wall.

In this terminal retaining construction of a press-connecting connector, the press-connecting blades are formed by stamping on each side wall of the press-connecting terminal to thereby form the window through the side wall. However, the interconnecting portion, extending from the window to the upper edge of the side wall, functions as a reinforcement portion for the press-connecting blade-formed portion, and therefore the press-connecting terminal will not be deformed by an external force.

In the first aspect of the present invention, terminal retaining construction of a press-connecting connector a retaining recess is formed in that portion of a bottom plate portion of the press-connecting terminal opposed to each of the windows, and the retaining recess can be retainingly engaged with the associated terminal retaining portion of the housing.

In this terminal retaining construction of a press-connecting connector, in addition to the window, the retaining recess is retained by the terminal retaining portion of the housing, and therefore the press-connecting terminal can be positively retained on the terminal retaining portions of the housing, and the shaking of the press-connecting terminal is positively prevented.

According to the second aspect of the present invention, there is provided a terminal retaining construction of a press-connecting connector comprising:

a press-connecting terminal having a pair of press-connecting blade members respectively formed by stamping on opposite side walls of the terminal, to thereby form a window through each of the side walls; and a housing having a terminal receiving chamber which is provided with terminal retaining portions lockable with the windows respectively so as to retain the terminal.

In the above-mentioned construction, preferably, each of the press-connecting blade members comprises a pair of press-connecting blades which are separated at a predetermined interval in a longitudinal direction of the terminal, and each of the windows is formed between the basal ends of the press-connecting blades.

In addition, in the above-mentioned construction, more preferably, each of the opposite side walls of the press-connecting terminal has an interconnecting portion extending upwardly from the window to an upper edge of the side wall.

Further, in the above-mentioned construction, preferably, a retaining recess is formed in that portion of a bottom plate portion of the press-connecting terminal opposed to each of the windows, and the retaining recess is lockable by the associated terminal retaining portion of the housing.

DESCRIPTION OF THE PREFERRED EMBODIMENT OF THE INVENTION

Figure 1:
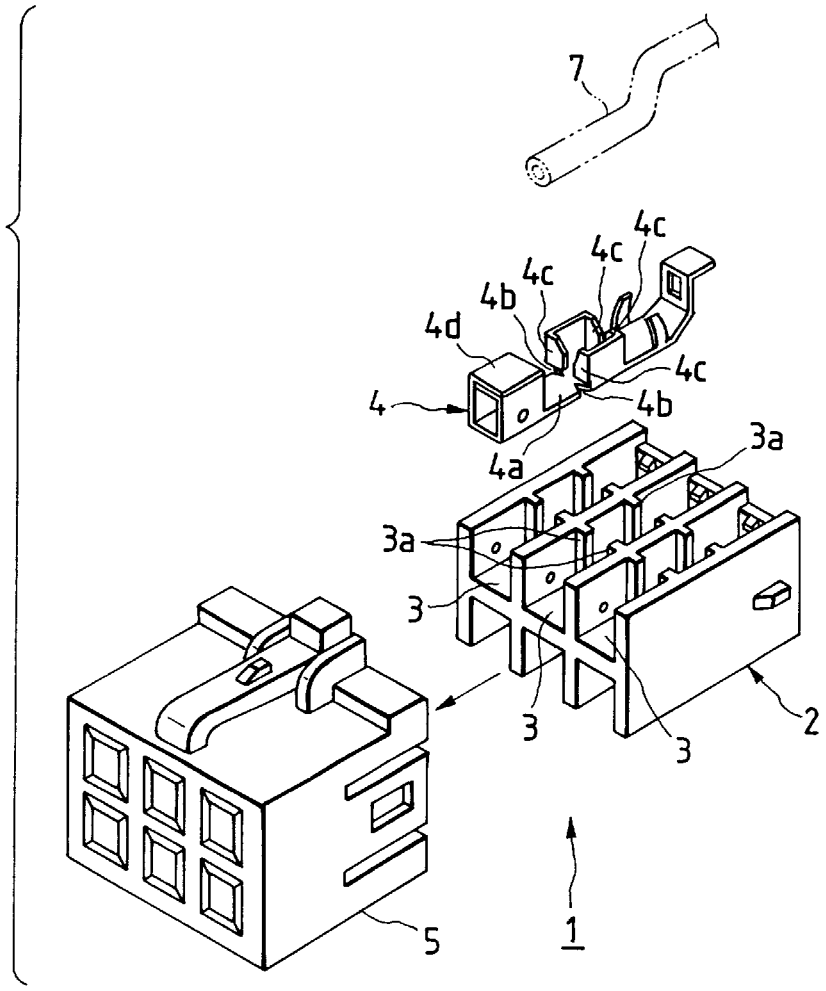
FIG. 1 PRIOR ART
FIG. 1 is an exploded, perspective view of a conventional press-connecting connector.
Figure 2:
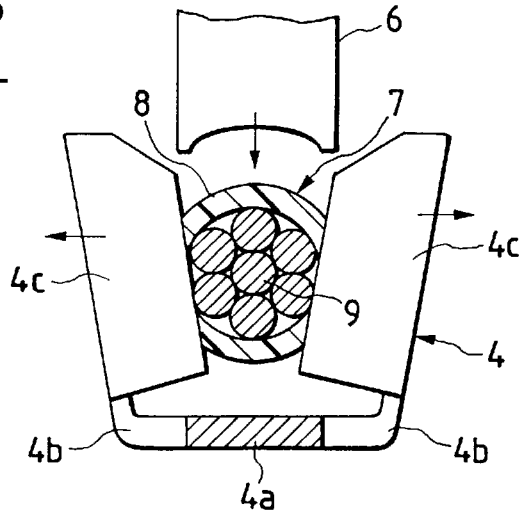
FIG. 2 PRIOR ART
FIG. 2 is a view showing a press-connected condition of a wire in the conventional press-connecting connector.
Figure 3:
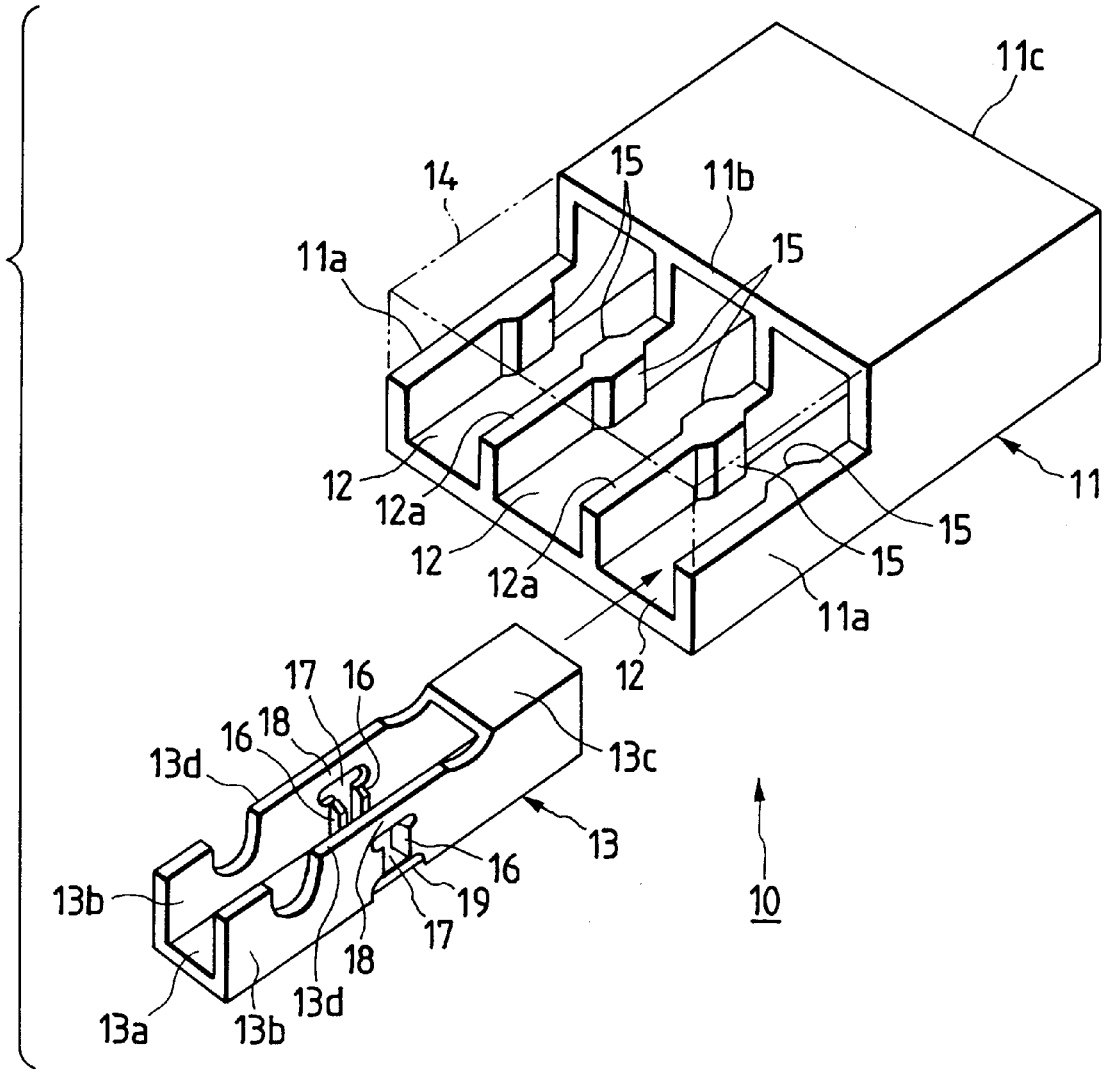
FIG. 3 is an exploded, perspective view of one preferred embodiment of a press-connecting connector of the invention.

FIG. 3 shows one preferred embodiment of a press-connecting connector 10 of the present invention. The press-connecting connector 10 comprises a tubular housing 11 of a square cross-section which is made of a synthetic resin, and has front and rear open ends, electrically-conductive press-connecting terminals 13 received respectively in a plurality of (three in this embodiment) terminal receiving chambers 12 in the housing 11, and a cover 14 of a synthetic resin removably attached to a notched portion 11*b*, formed in an upper portion of a rear end portion of the housing 11, to cover the press-connecting terminals 13.

Figure 4A:
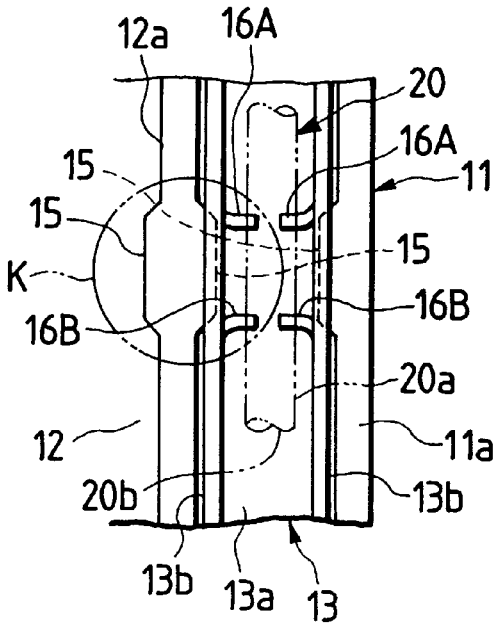
FIG. 4(A) is a fragmentary plan view showing a condition in which a press-connecting connector is retained on terminal retaining portions of a housing of the press-connecting connector.
Figure 4B:
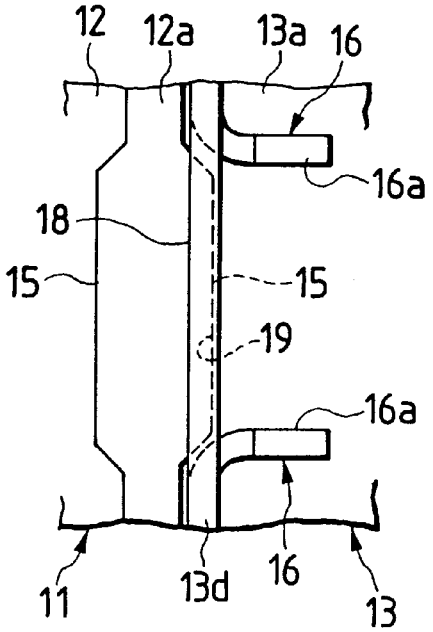
FIG. 4(B) is an enlarged plan view of a portion K of FIG. 4(A)

As shown in FIGS. 3 and 4, terminal retaining portions 15 each in the form of a trapezoidal block are integrally formed respectively on opposite sides of each of partition walls 12*a* and opposite side walls 11*a* and 11*b* of the housing 11, the partition walls 12*a* and the opposite side walls 11*a* and 11*b* forming the terminal receiving chambers 12 in the housing 11. A front portion of the housing 11 is formed into a tubular portion 11*c* of a square cross-section from which the partition walls 12*a* extend.

Figure 5:
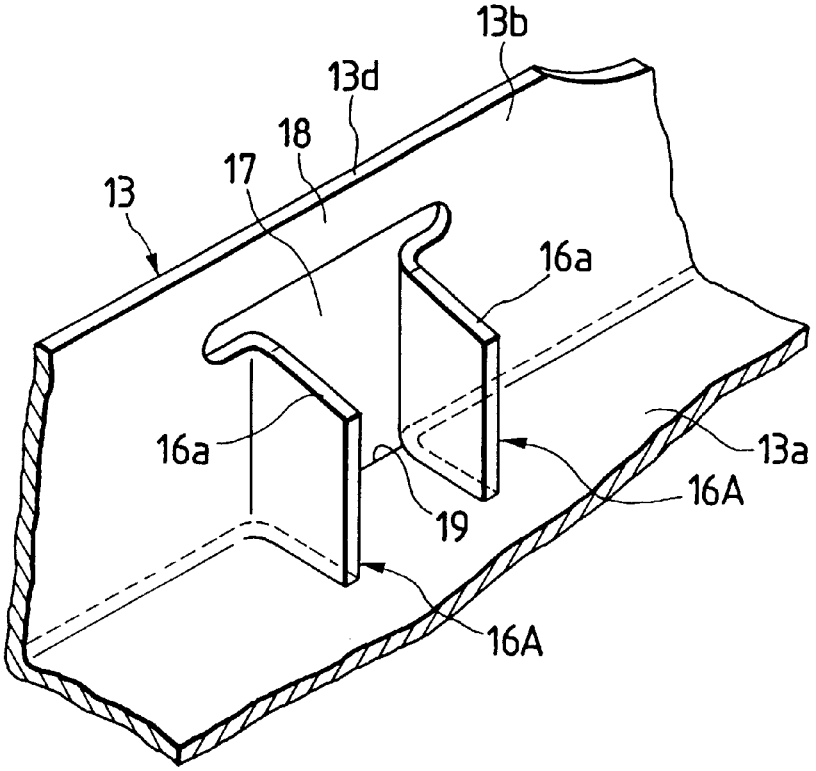
FIG. 5 is an enlarged perspective view showing press-connecting blades of the press-connecting terminal.

As shown in FIGS. 3 to 5, the press-connecting terminal 13 has a channel-shaped cross-section defined by a bottom plate portion 13*a* and opposite side walls 13*b* and 13*b*, and a front portion of the terminal 13 is formed into a tubular contact portion 13*c* of a square cross-section for fitting on a terminal of a mating connector. A pair of inwardly-directed press-connecting blades 16A and 16A (or 16B and 16B) are formed by stamping on each of those portions of the opposite side walls 13*b* and 13*b* of the press-connecting terminal 13 which are to be opposed respectively to the associated terminal retaining portions 15 of the housing 11. Therefore, a window 17 of a generally rectangular shape for retaining engagement with the terminal retaining portion 15 of the housing 11 is formed through each side wall 13*b* between each pair of press-connecting blades 16A and 16A (or 16B and 16B). An upper edge 16*a* of each press-connecting blade 16 is slanting downward toward its distal end so as to facilitate the press-connecting of a sheathed wire 20 to the press-connecting blades 16. Each of the side walls 13*b* of the press-connecting terminal 13 has an interconnecting portion 18 extending upwardly from the window 17 to an upper edge 13*d* of the side wall 13*b*. A retaining recess 19 for retaining engagement with a lower portion of the terminal retaining projection 15 of the housing 11 is formed in that portion of the bottom plate portion 13*a* of the press-connecting terminal 13 opposed to each of the windows 17.

In the press-connecting connector 10 of this embodiment, when the press-connecting terminal 13 is inserted into the terminal receiving chamber 12 in the housing 11 as indicated by an arrow of FIG. 3, the windows 17 formed respectively through the opposite side walls 13*b* and 13*b* of the press-connecting terminal 13, as well as the retaining recesses 19 formed in the bottom plate portion 13*a*, are retainingly fitted respectively on the terminal retaining portions 15 of the housing 11, as shown in FIG. 4(A). Thereafter, an insulating sheath 20*a* of the sheathed wire 20 is pressed against the pairs of press-connecting blades 16 through the slanting portions 16*a*, and is cut by these blades 16 to be press-connected to a conductor 20*b* of the sheathed wire 20. Then, the cover 14 is attached to the housing to cover the press-connecting terminals 13. In this terminal-mounting operation, each terminal retaining portion 15 of the housing 11 is easily fitted into the associated window 17 between the pair of press-connecting blades 16 through arcuately-bent portions of the press-connecting blades 16, so that the press-connecting terminal 13 is positively retained by the terminal retaining portions 15 of the housing 11.

The press-connecting blades 16 are formed by stamping on each side wall 13*b* of the press-connecting terminal 13 to thereby form the window 17 through the side wall 13*b*. Despite this construction, the interconnecting portion 18, extending from the window 17 to the upper edge 13*d* of the side wall 13*b*, functions as a reinforcement portion for the press-connecting blade-formed portion, and prevents the strength of the press-connecting blade-formed portion from being reduced. Therefore, the deformation of the press-connecting terminal 13 by an external force is positively prevented, and the force of holding the wire between the press-connecting blades 16 is enhanced. And besides, in addition to the window 17, the retaining recess 19 is retained by the terminal retaining portion 15 of the housing 11 as described above, and therefore the press-connecting terminal 13 can be positively retained on the terminal retaining portions 15 of the housing 11 without shaking.

In the above embodiment, although the terminal retaining portion of the housing is in the form of a trapezoidal block, it may have any other suitable shape such as a triangular prism and a hook-shape.

As described above, in the first aspect of the present invention, the strength of the press-connecting blade-formed portion of the press-connecting terminal is prevented from being reduced, and the press-connecting terminal can be easily and positively retained on the terminal retaining portions of the housing.

In addition, in the present invention, the press-connecting blades are formed by stamping on each side wall of the press-connecting terminal to thereby form the window through the side wall. However, the interconnecting portion, extending from the window to the upper edge of the side wall, functions as the reinforcement portion for the press-connecting blade-formed portion, and therefore the deformation of the press-connecting terminal by an external force is positively prevented, and the force of holding the wire by the press-connecting blades is further increased.

Further, in the invention of, in addition to the window, the retaining recess is retained by the terminal retaining portion of the housing, and therefore the press-connecting terminal can be positively retained on the terminal retaining portions of the housing without shaking.

While there has been described in connection with the preferred embodiment of the invention, it will be obvious to those skilled in the art that various changes and modifications may be made therein without departing from the invention, and it is aimed, therefore, to cover in the appended claim all such changes and modifications as fall within the true spirit and scope of the invention.

What is claimed is:

1. A terminal retaining construction of a press-connecting connector comprising:

a press-connecting terminal having a pair of press-connecting blade members respectively formed by stamping on opposite side walls of said terminal, to thereby form a window through each of said side walls; and a housing having a terminal receiving chamber which is provided with terminal retaining portions lockable with said windows respectively so as to retain said terminal.

2. The terminal retaining construction according to claim 1, in which each of said press-connecting blade members comprises a pair of press-connecting blades which are separated at a predetermined interval in a longitudinal direction of said terminal, and each of said windows is formed between the basal ends of said press-connecting blades.

3. The terminal retaining construction according to claim 2, wherein each of said opposite side walls of said press-connecting terminal has an interconnecting portion extending upwardly from said window to an upper edge of said side wall.

4. The terminal retaining construction of a press-connecting connector according to claim 1, in which a retaining recess is formed in that portion of a bottom plate portion of said press-connecting terminal opposed to each of said windows, and said retaining recess is lockable by the associated terminal retaining portion of said housing.

5. The terminal retaining construction of a press-connecting connector according to claim 2, in which a retaining recess is formed in that portion of a bottom plate portion of said press-connecting terminal opposed to each of said windows, and said retaining recess is lockable with the associated terminal retaining portion of said housing.

6. The terminal retaining construction of a press-connecting connector according to claim 3, in which a retaining recess is formed in that portion of a bottom plate portion of said press-connecting terminal opposed to each of said windows, and said retaining recess is lockable with the associated terminal retaining portion of said housing.

7. The terminal retaining construction of a press-connecting connector according to claim 1, in which each of said terminal retaining portions is in the form of a trapezoidal block.

* * * * *